US006648348B2

(12) United States Patent
Link

(10) Patent No.: US 6,648,348 B2
(45) Date of Patent: Nov. 18, 2003

(54) SKI-SNOWBOARD

(76) Inventor: Mark Link, P.O. Box 170234, Boise, ID (US) 83717

( * ) Notice: Subject to any disclaimer, the term of this patent is extended or adjusted under 35 U.S.C. 154(b) by 0 days.

(21) Appl. No.: 09/953,246

(22) Filed: Sep. 13, 2001

(65) Prior Publication Data

US 2002/0050693 A1 May 2, 2002

Related U.S. Application Data

(60) Provisional application No. 60/232,581, filed on Sep. 13, 2000.

(51) Int. Cl.[7] ..... B62B 13/08

(52) U.S. Cl. ..... 280/14.25; 280/14.26; 280/26; 280/22.1

(58) Field of Search ..... 280/14.25, 14.26, 280/28.15, 28.16, 26, 22.1

(56) References Cited

U.S. PATENT DOCUMENTS

| | | | | | |
|---|---|---|---|---|---|
| 3,583,722 | A | | 6/1971 | Jacobson | 280/16 |
| 4,043,565 | A | | 8/1977 | Mogannam | 280/11.12 |
| 4,161,324 | A | * | 7/1979 | Colvin | 280/14.25 |
| 4,165,091 | A | | 8/1979 | Chadwick | 280/12 H |
| 4,194,753 | A | * | 3/1980 | Schrishuhn, Jr. | 280/13 |
| 4,221,394 | A | * | 9/1980 | Campbell | 280/14.25 |
| 4,521,029 | A | | 6/1985 | Mayes | 280/7.14 |
| 4,784,233 | A | * | 11/1988 | Favors | 280/14.25 |
| 5,249,816 | A | * | 10/1993 | Southworth | 280/14.25 |
| 5,285,742 | A | * | 2/1994 | Anderson | 114/43 |
| 5,411,282 | A | * | 5/1995 | Shannon | 280/606 |
| 5,551,728 | A | | 9/1996 | Barthel et al. | 280/818 |
| 5,613,695 | A | * | 3/1997 | Yu | 280/14.25 |
| 6,341,786 | B1 | * | 1/2002 | Kermis | 280/14.22 |

* cited by examiner

*Primary Examiner*—Brian L. Johnson
*Assistant Examiner*—Brian L Swenson
(74) *Attorney, Agent, or Firm*—Pedersen & Co. PLLC; Ken J. Pedersen; Barbara S. Pedersen

(57) ABSTRACT

A ski-snowboard device has a support board for the user and a plurality of ski pairs mounted to the underside of the board. The ski-snowboard has a steering and suspension system, connecting the skis in each pair, to provide paired steering and independent suspension. Each steering and suspension system preferably comprises two pivoting generally-V-shaped arms connecting the board to the skis, wherein the V-shaped arms are spaced apart at their top end connections to the board, and each connect to different portions of rocker members that hold the skis. The V-shaped arms pivot relative to the board, and the rocker members pivot relative to the arms and also relative to the skis. Shock-absorbing/biasing systems cushion vibrations and tune the suspension and steering. Thus, the skis move right and left, move to their inside edges, and swing forward and rearward, to properly steer the ski-snowboard right and left and up and down terrain, for enhanced handling and control by the user.

11 Claims, 20 Drawing Sheets

SKI-SNOWBOARD

This application claims priority of my prior provisional application, Ser. No. 60/232,581, filed Sep. 13, 2000, entitled "Snowboard with Skis."

BACKGROUND OF THE INVENTION

1. Field of the Invention

The present invention generally relates to outdoor sporting goods. More specifically, the present invention relates to recreational devices for riding, sliding, gliding and other transportation over a snow-covered surface.

2. Related Art

Many different devices are known for recreational transportation over a snow-covered surface. The two most common devices on ski slopes today are traditional skis and traditional snowboards. Skis have the benefit of having a smaller surface in contact with the snow, thereby producing less drag. Skis also place the user's feet an inch or so away from the surface on the snow and spread his/her weight over a longer base, thereby creating a low center of gravity. Skis are well-known for their ability to corner and carve more effectively than snowboards. Skis'versatility and mobility is due to their narrow riding surface and the utilization of two riding edges when turning or carving, as compared to the one edge used by a snowboard. Snowboards are popular, especially with younger users, for their differences from skis and their ease of transport and economy.

One of the major disadvantages of a snowboard is that, due to the fact that the rider is riding a single board, it takes more strength to carve and turn, because the rider has to kick use both upper and lower body to turn. Also, since the snowboard must have such a wide riding surface, the rider ends up doing more sliding instead of riding when traveling on hard-packed snow.

Patent literature describes several devices with runners for transportation across an ice-covered surface. For instance, U.S. Pat. No. 3,583,722 (Jacobsen) discloses a collapsible bobsled comprising a seating platform having four runners; U.S. Pat. No. 4,043,565 (Mogannam) discloses a recreational device having runners; U.S. Pat. No. 4,521,029 (Mayes) discloses an iceboard. However, none of these devices are useful for transportation across a snow-covered surface, such as a ski slope.

U.S. Pat. No. 4,165,091 (Chadwick) discloses a snowboard with four skis running under a board. However, Chadwick fails to disclose a snowboard having both an independent suspension and independent steering.

U.S. Pat. No. 5,551,728 (Barthel, et al.) discloses a gliding board for siding across a snow-covered surface. However, the Barthel, et al. board uses a pair of runners rather than four runners.

What is still needed, therefore, is a device for recreational transportation over a snow-covered surface having benefits of: a broad, single board for the user to stand upon; a smaller board surface in contact with the snow-covered surface; the multiple riding surfaces of skis; the turning, carving and cornering abilities of skis; and independent steering. The present invention addresses these needs.

SUMMARY OF THE INVENTION

The present invention is a ski-snowboard device, which comprises a single board for a user to stand upon, and a smaller board surface in contact with a snow-covered surface such as the multiple riding surfaces of skis; wherein the device exhibits the benefits of independent steering and the benefits of turning, carving and cornering similar to those of skis.

The present invention has an elongated board with multiple skis or runners mounted preferably in pairs to the underside of the body, one pair near the front and one pair near the rear of the board. The skis of each pair are laterally-spaced and parallel to each other. Preferably, the right skis of both pairs are in a single line parallel to the length of the board and the left skis of both pairs are in a single line parallel to the length of the board. The four runners are generally parallel to the length of the board and give the board four separate riding surfaces.

The invented board has paired steering, wherein the two front skis are both connected to and cooperate with a first steering system and the two rear skis are both connected to and cooperate with a second steering system. The invented board preferably also includes independent suspension for each ski. The preferred steering system and suspension are important in reaching the many performance objectives of the invention: better handling, smoother turning, shorter turning radiuses, better cornering and carving, better performance in hard-packed snow or deep powder, and smoother transversing of moguls, when compared to existing devices for transportation across a snow-laden surface.

The preferred elongated board is preferably approximately the same length as the common skateboard, but may vary in length and shape depending on the use. For example, freestyle boards and all-mountain/directional (slalom) style boards according to the invention are envisioned. The preferred board also includes deep, radiused or generally semicircular side cuts in its two side edges, unlike the straight side edges found in conventional skateboard designs. The inventor also envisions that special compositions/layers of material may be developed for various boards for specialized performance, according to the invention.

DESCRIPTION OF THE PREFERRED EMBODIMENTS

Figure 1:
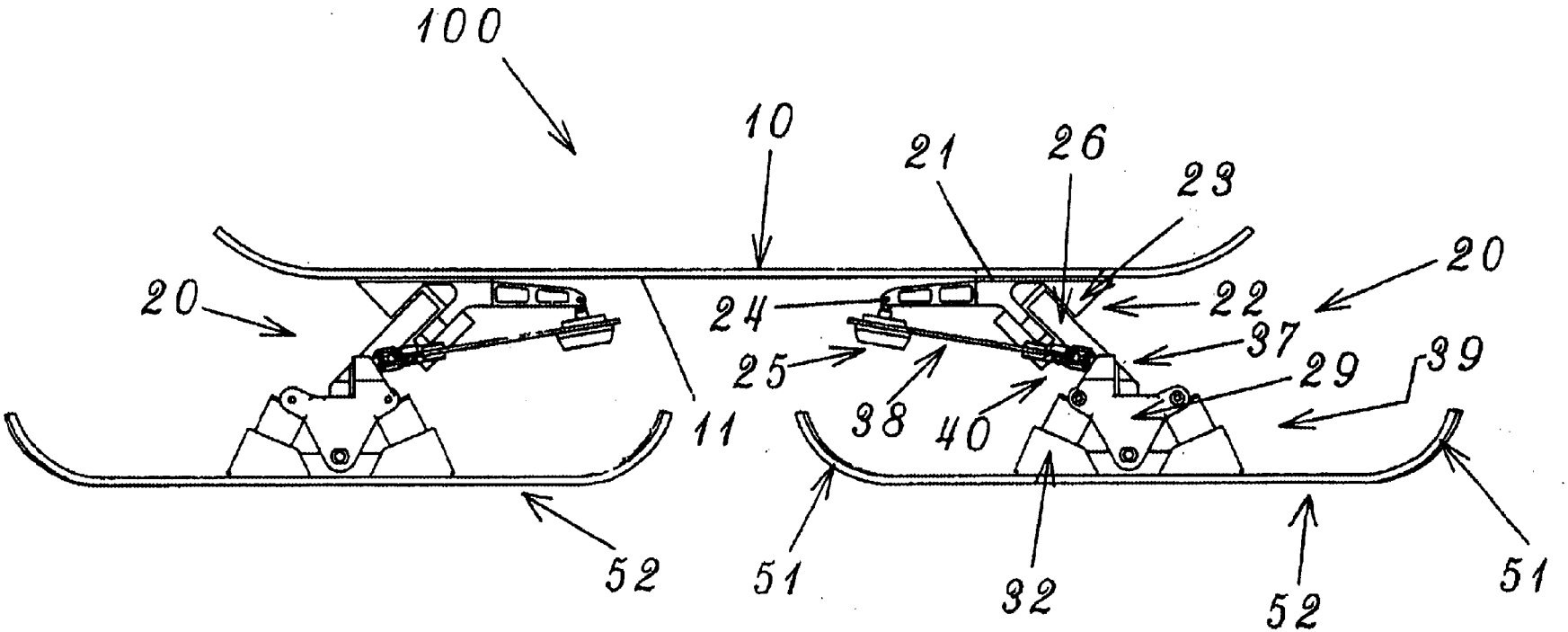
FIG. 1 is a side view of one embodiment of the invented ski-snowboard.

Referring to the Figures, there are shown some, but not the only, embodiments of the invented snowboard with skis, herein called a "ski-snowboard." The invented ski-snowboard combines the benefits of both a snowboard and skis, and does so with enhanced steering and suspension systems.

Within the description of this application, the following terms have the following meanings, for each of discussion and clarity, unless defined explicitly otherwise within the description: "horizontal" is generally parallel to the top surface of the board, "clockwise," and "counterclockwise" are as to a user looking down while standing on and using the ski-snowboard.

The present invention comprises a ski-snowboard 100 comprising: a board member or deck 10, at least one steering and suspension mechanism 20, and at least one pair of generally parallel, generally planar, spaced skis 52, 52'. Preferably, as described below, a total of four skis 52, 52' are used, two steering and suspension mechanisms 20, and one deck 10 are used.

In general, the steering and suspension mechanisms are adapted for paired steering of the skis in each pair of skis, and for firm and controllable suspension of the board on the skis. By movement of the board by the rider, the steering and suspension mechanism steers the skis either right or left, and tips/pulls the skis onto their edges as appropriate for turning, carving and cornering. Also, all skis each preferably have independent forward and rearward movement for crossing moguls or other uneven terrain. The steering and suspension include tensioning and shock devices so that the rider may have consistent and accurate control of the ski-snowboard during use, rather than a "floppy," unpredictable, and uncontrollable ride.

The preferred steering and suspension mechanism includes two generally-V-shaped members, each with a "center" (the point region of the "V") and each with two arms that diverge from the center to connect to the skis (via a base member). The center and two arms of each V-shaped member lie in a plane, and are connected to the deck of the ski-snowboard so that they rotate in their respective planes.

More specifically, each of the V-shaped members is rotatably connected at or near its center to the deck of the ski-snowboard, preferably by means of being rotatably connected to a truck member that attaches to the underside of the board. The rotatable connections of the centers of the two V-shaped members are preferably distanced apart on a line parallel to the length of the deck, with one of the connections forward from the other connection. The rotatable connections position each V-shaped member to lie in and rotate in a plane that is non-parallel to the deck of the board, the plane extending down and forward from near the deck to near the ski centers. The plane of the forward V-shaped member is angled downward more than the plane of the rearward V-shaped member. The forward V-shaped member rotates to allow the skis to turn right and left, and it pivotally connects to the skis (preferably to base members on the skis) so that the skis may pivot/tip from ski side-edge to ski side-edge. The rearward V-shaped member extends to connect to the skis (preferably to the same base members on the skis, at a position rearward from the forward V-shaped member's connection to the base members and preferably by a U-joint), so that the rearward V-shaped member may pull and push the skis to tip onto their side-edges. Tensioning is provided, preferably in the movement of the forward V-shaped member relative to the deck (preferably relative to the truck under the deck), to prevent wobble and lack of control by biasing the steering and suspension system to return to its "starting" straight, non-turning position.

In addition, the skis are pivotally mounted for independent forward and rearward movement relative to both V-shaped members, and, therefore forward and rearward movement relative to the deck. This forward and rearward movement provides for smooth travel over uneven terrain. Shock absorbers or other tensioning devices are supplied to moderate/cushion this movement by biasing the skis to return to a level position parallel to the deck. Other than parts of the shock absorbers or tensioning devices, the parts of the steering and suspension system are preferably rigid members, for example, of metal or durable plastic or composite material.

1. The Deck

The deck 10 comprises an elongated, continuous, preferably single piece, main body 12, which is generally similar to the shape of a "skateboard." The main body 12 width is less than its length, preferably less than ½ of the length of the board, resulting in it being called a "long, narrow" main body. The deck 10 can be made of wood, plastic, a composite or layered material, or other materials, including those that are currently available and those that may be developed in the future. The deck 10 may be shaped to fit the needs and wishes of an individual user, for instance having an upward curved front and/or rear edge. The deck 10 is preferably 36 inches in length, about 12–15 inches wide, and may be wider at its ends than at its middle.

2. The Steering and Suspension Mechanism

Mounted to the bottom 11 of the deck 10 is at least one steering and suspension mechanism 20 attached to a ski system, which ski system preferably comprises a spaced pair of parallel, planar skis 52. Preferably two pairs of steering and suspension mechanisms 20 and their corresponding skis 52, 52' are located under a particular deck 10. The first mechanism 20 with skis 52 is located at or near the front 13 of the deck 10 and the second mechanism 20 with skis 52' is located at or near the rear 14 of the deck 10. The first (front) and second mechanisms (rear) 20 are preferably mirror images of each other, as may be seen to best advantage in FIG. 1, facing in opposite directions to the front and the rear.

Each steering and suspension mechanism 20 further comprises: a truck system 22 attaching to the deck 10, a rocker base system 39 attaching to a ski 52; a cross-arm system 37 connecting a first end 122 of the truck system 22 to the rocker base system 39 and a pivot rod system 38 connecting a second end 124 of the truck system 22 to the rocker base system 39. Preferably, the steering and suspension mechanism 20 will elevate the deck 10 top surface about 6½ to 7½ inches from the surface of the snow, that is, about 6 ½ to 7 ½ inches from the bottom of the skis.

a. The Truck System

The truck system 22 comprises a truck base 23 with a deck attachment 21 for attaching the truck system (or "truck") 22 to the deck 10. The upper area or plate of the truck base 23 serves as a deck attachment 21, and the lower regions of the truck base 23 serve as pivotal/rotational attachment points for the cross-arm system 37 and the pivot rod system 38. Specifically, the cross-arm system 37 pivotally attaches to a lower first end 122 of the truck base at a cross-arm pivot 26. The pivot rod system pivotally attaches to a lower second end 124 of the truck base at a pivot pin 24. These pivotal/rotational attachments allow: 1) the cross-arm system to pivot/rotate about 30–45° degrees relative to the deck 10 within a plane that is inclining down and forward from the deck; and 2) the pivot rod system 38 to pivot about 30–45° degrees generally transverse to the length of the deck 10 in a plane that also inclines down and forward from the deck but has a greater horizontal component than does the plane of the cross-arm system. Generally speaking, because both the cross-arm and the pivot arm are preferably at less than or equal to 45 degrees from the deck, the cross-arm and pivot arm may be said to pivot or rotate in a "generally horizontal" plane, with the understanding that the preferred plane of pivot/rotation has a vertical component so that the cross-arm and pivot arm reach down to connect to the skis.

The truck system 22 preferably attaches to the bottom side 11 of the deck 10 by the use of screws received through holes or a "click-in" tongue-in-groove attachment (not shown) located in the deck attachment 21, said screws then fastened through the holes and into the deck 10. Such an attachment fixedly attaches the deck 10 to the base 23 so that the length of the truck base 23, (from said first end to said second end) runs parallel to the length of the deck 10. Preferably, the first end of the truck base 23 is pointing toward an end of the deck 10, while the second end of the truck base 23 is pointing toward the center of the deck 10. Thus, in an embodiment having two pairs of skis, both of the second ends of the truck base 23 will be pointing to the center point of the deck 10 (midpoint of the transverse centerline of the deck), and both of the first ends of the truck base 23 will be pointing toward the midpoint of the ends of the deck 10.

b. The Pivot Rod System

The pivot rod system 38 connects the rocker base system 39 to the second end of the truck system 22. The pivot rod system 38 comprises: a pivot pin 24, a pivot rod anchor bushing 25, a preferably boomerang-shaped pivot rod 35, and pivot rod attachments 40, 40'.

Figure 4:
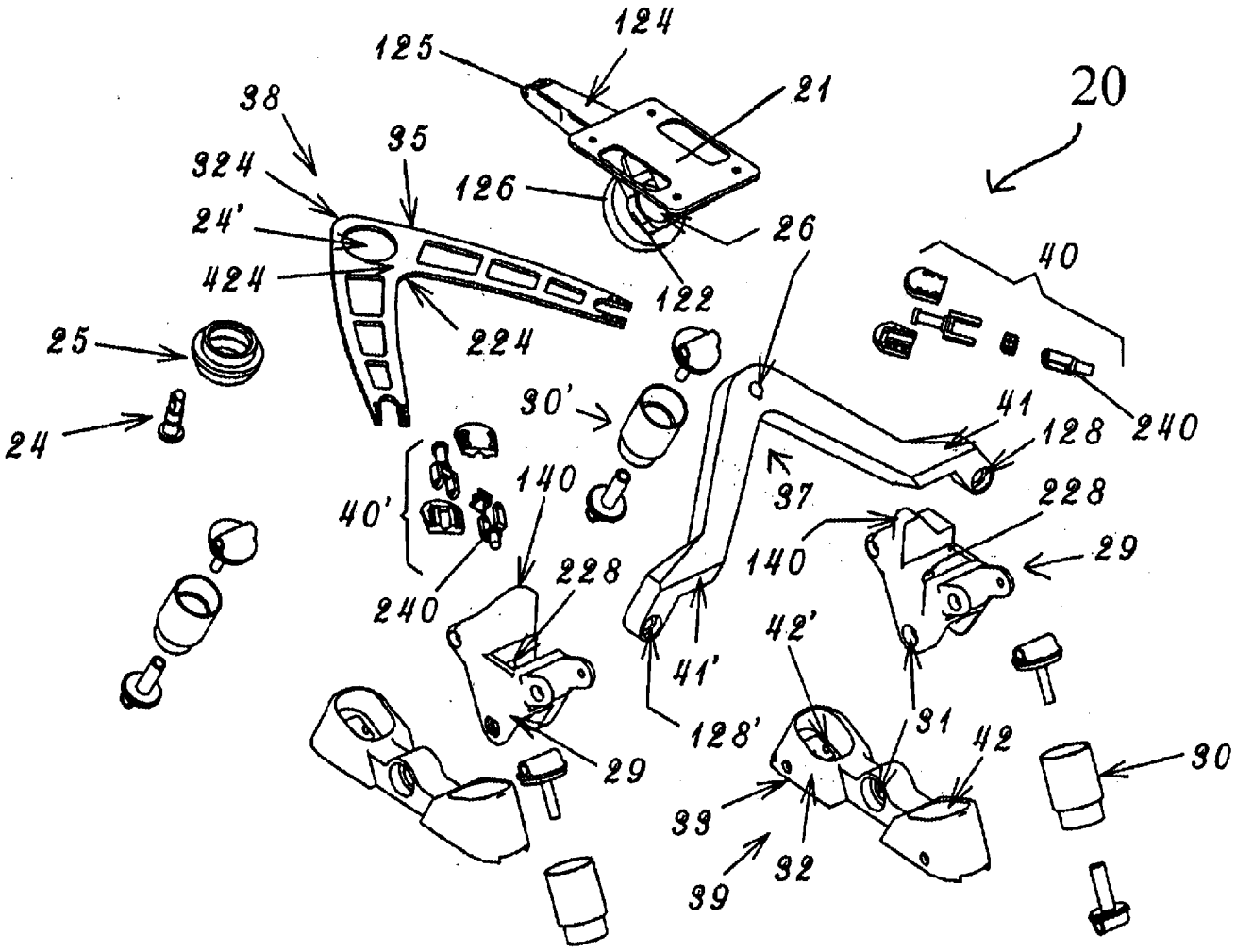
FIG. 4 is a perspective exploded view of the pieces-parts of the steering and suspension system of FIG. 3.
Figure 5:
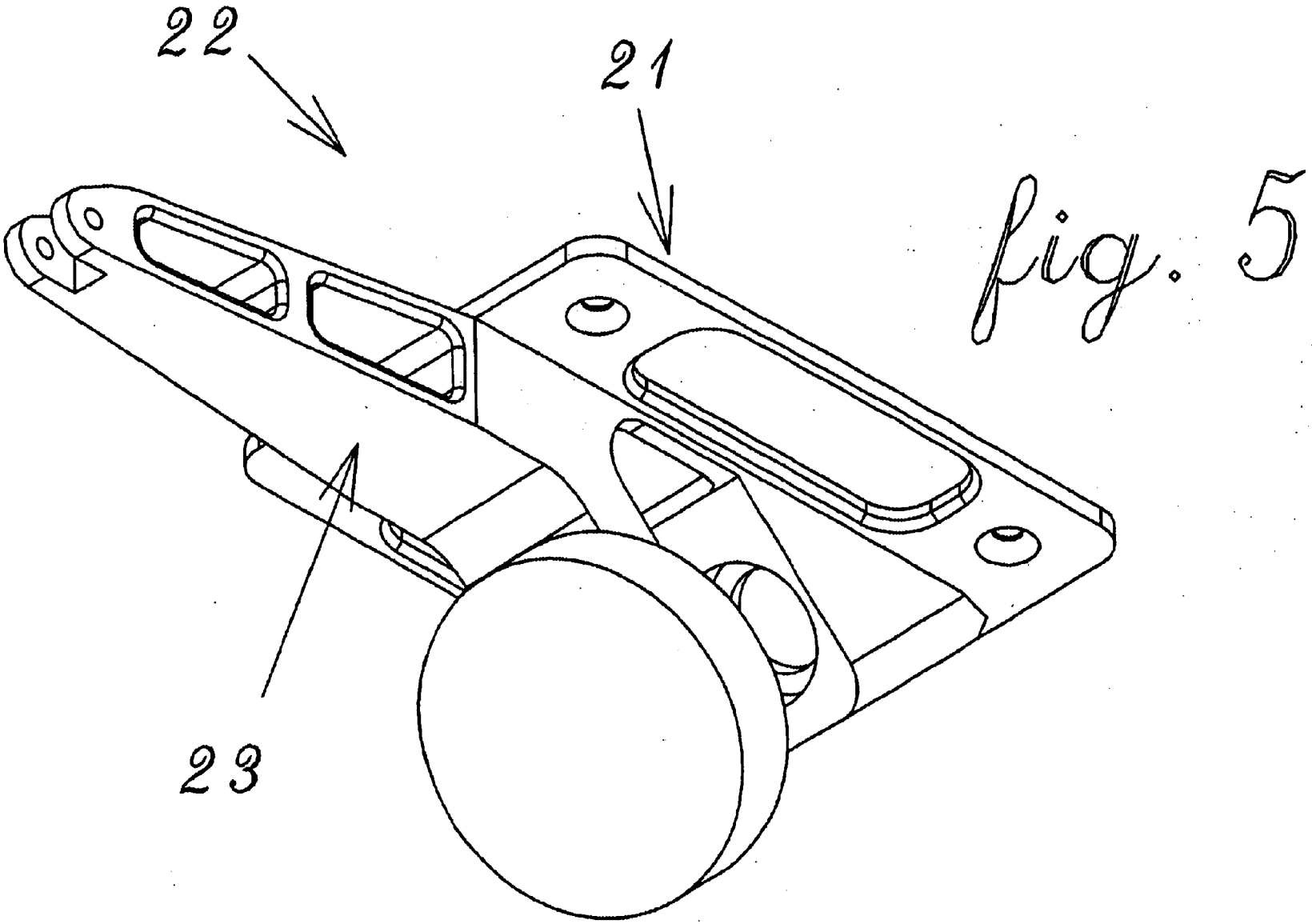
FIG. 5 is a bottom perspective view of the truck system of the embodiment of FIGS. 1–4.
Figure 6A:
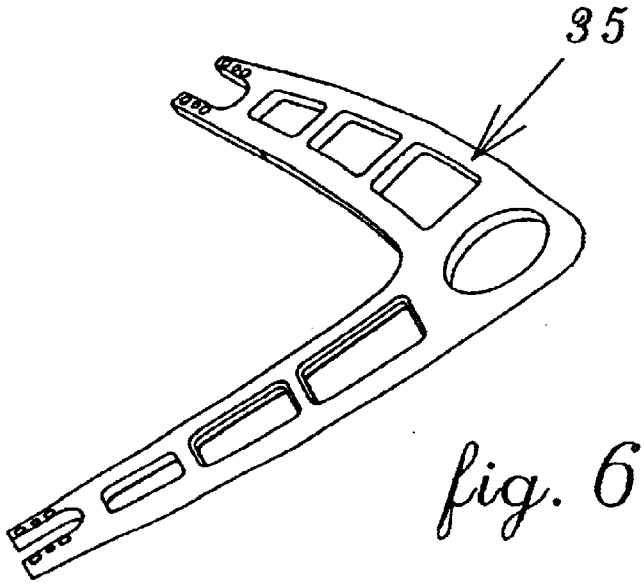
FIG. 6A is a perspective view of one embodiment of a pivot rod of the invention.
Figure 6B:
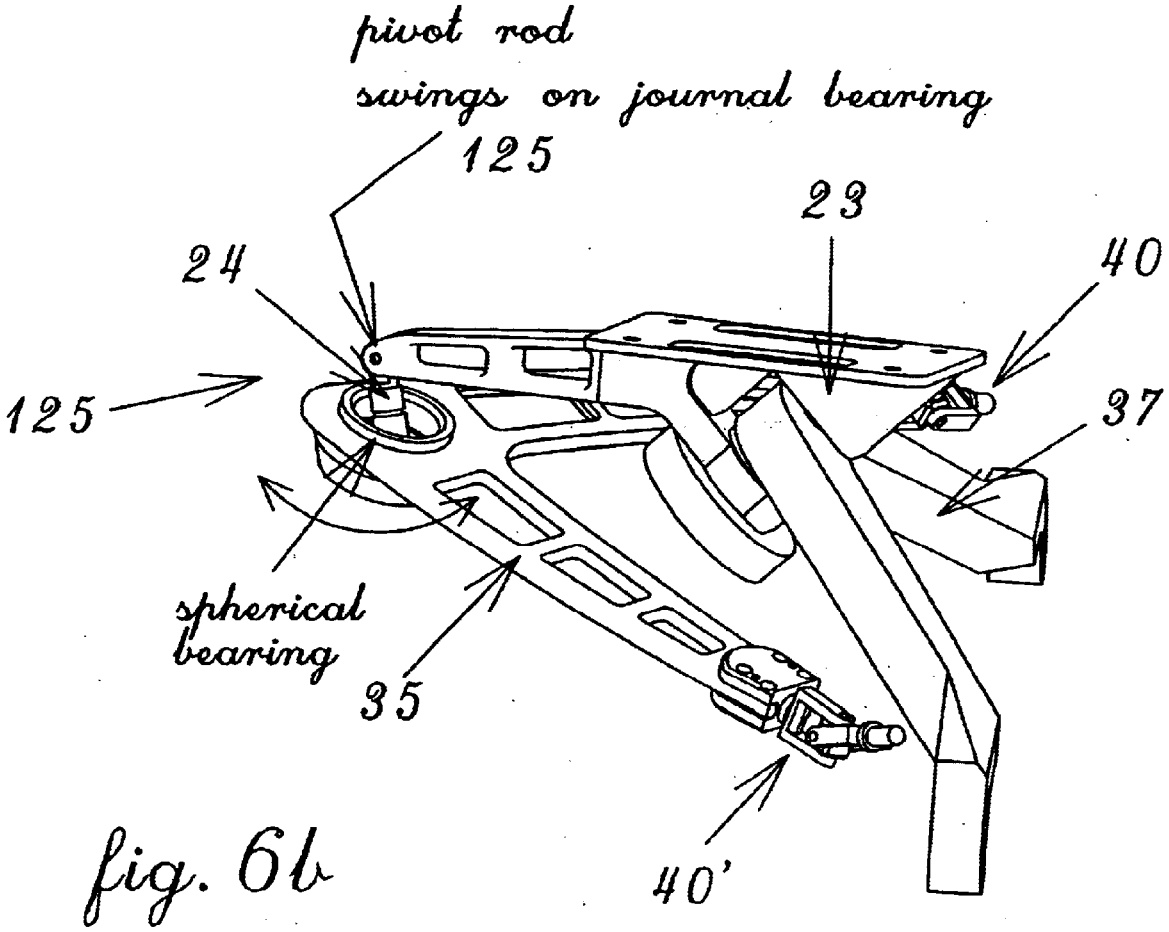
FIG. 6B is a side schematic view of the connection of a pivot rod to the truck system of FIG. 5.

The pivot rod 35 is connected to the truck system 22 in such a manner that the rod 35 both swings and rotates relative to the truck base 23, that is, the pivot rod has more than one direction of movement relative to the deck. The pivot pin 24 extends through a hole in the pivot rod 35 and is connected to the second end 124 of the truck base 23 at a journal bearing or other joint 125 that allows the pin, and therefore the rod 35, to swing forward and rearward in a single plane relative to the truck base 23 (generally vertical plane parallel to the longitudinal axis of the deck). The pivot rod anchor bushing 25 or other spherical bearing rotatably receives the lower end of the pivot pin 24 so that the rod 35 may rotate (pivot) around the pin, within the limits of this rotation caused by the rod being connected at its two ends to the two rocker links 29. The pivot pin 24 connection allows the pivot rods 35 to rotate (pivot) around pivot pin 24 within a plane that is perpendicular to the pin longitudinal axis, which may be called a generally horizontal plane, or, more precisely for the preferred embodiment, a plane at about 0–30 degrees from horizontal. The placement of pin 24 and hole 24', and hence the point of pivot around pin 24, may be moved "forward" toward edge 224 or "backward" toward edge 324 to change the pivot location to adjust the amount and action of the pivot. In an especially-preferred embodiment, the pivot location is moved about ½ inch "forward" of where it is shown in FIG. 4, that is, to a location 424 about ¾ of the distance from the rear edge 324 to the front edge 224. This especially-preferred pivot point placement allows a wider range of turning and ability to go onto the skis edges, enhancing performance for many riders. Alternatively, an adjustable system may be installed to let the user occasionally adjust the pivot location forward and backward for fine-tuning of the action of the user's ski-snowboard.

The two second ends of the pivot rod 35 respectively extend to the pivot rod U-joint attachments 40, 40', which include pivot members 240 that connect to top anchor points 140 of each rocker link 29. The pivot rod system 38 cooperates with the cross-arm system 37 to create the paired, synchronous steering of the skis 52, 52'.

c. The Cross-Arm System

The cross arm system 37 attaches the rocker link 29 to the first end of the truck base 23. The cross-arm system 37 comprises a central pivot 26, a cross-arm 27, and a pair of cross-arm pivots 28, 28'.

The cross-arm system 37 connects to the first end of the truck base 23 at the central pivot 26, so that the two arms 41, 41' of the V-shaped cross-arm 27 are able to extend downward and outward from the attachment. At this attachment, the cross-arm 27 is able to rotate (pivot) in a plane that is at preferably about 45 degrees to the plane of the deck 10 (preferably in the range of about 22 degrees down from the bottom surface of the deck to about 60 degrees down from the bottom surface of the deck). This ability to pivot allows the skis 52 to pivot in relation to the deck 10, thereby allowing for the turning of the invented device on the snow-covered surface. The cross-arm 27 serves to support the deck 10 above the skis 52 and serves to position the skis 52 a distance apart.

Figure 2:
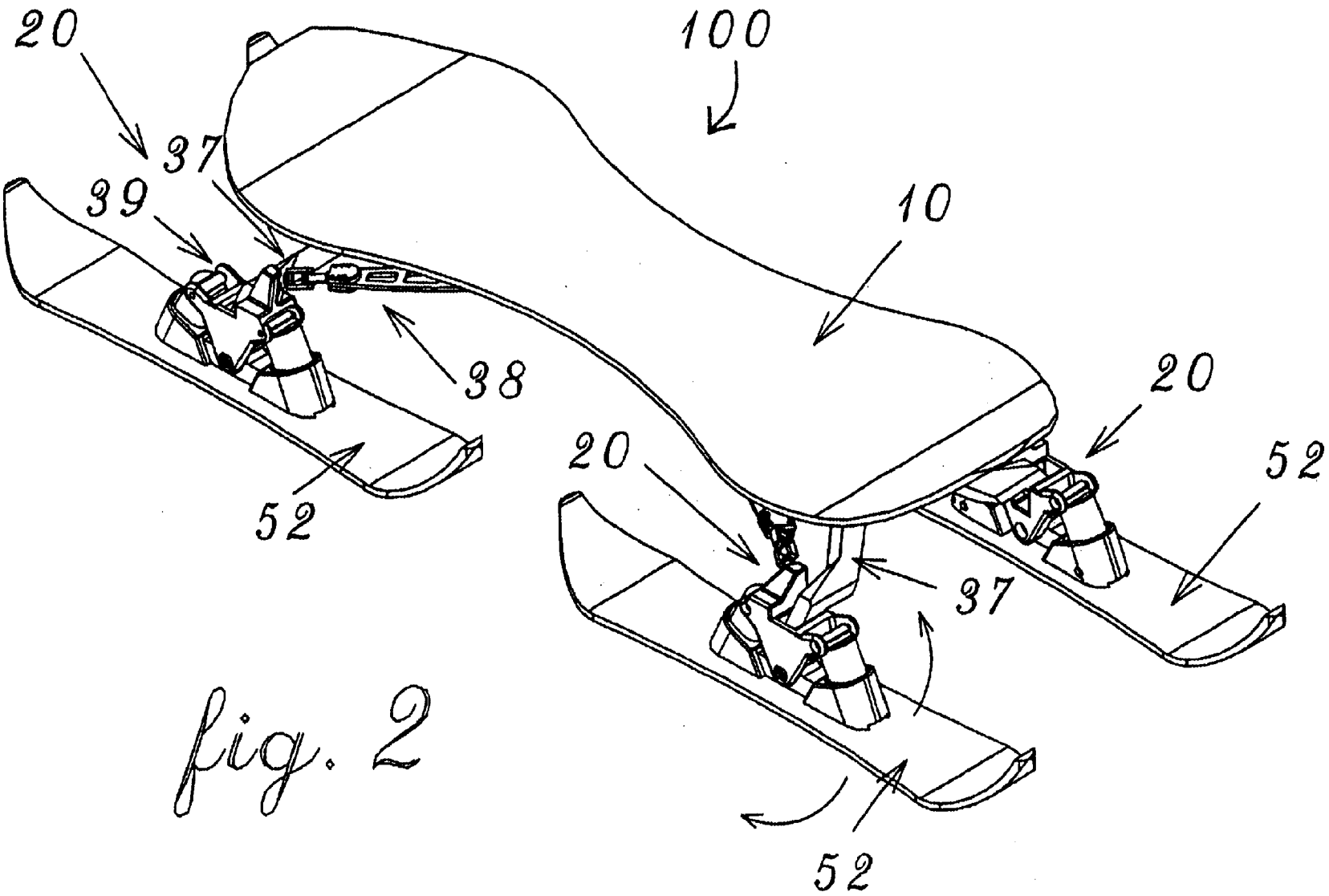
FIG. 2 is a front perspective view of the ski-snowboard of FIG. 1.
Figure 3:
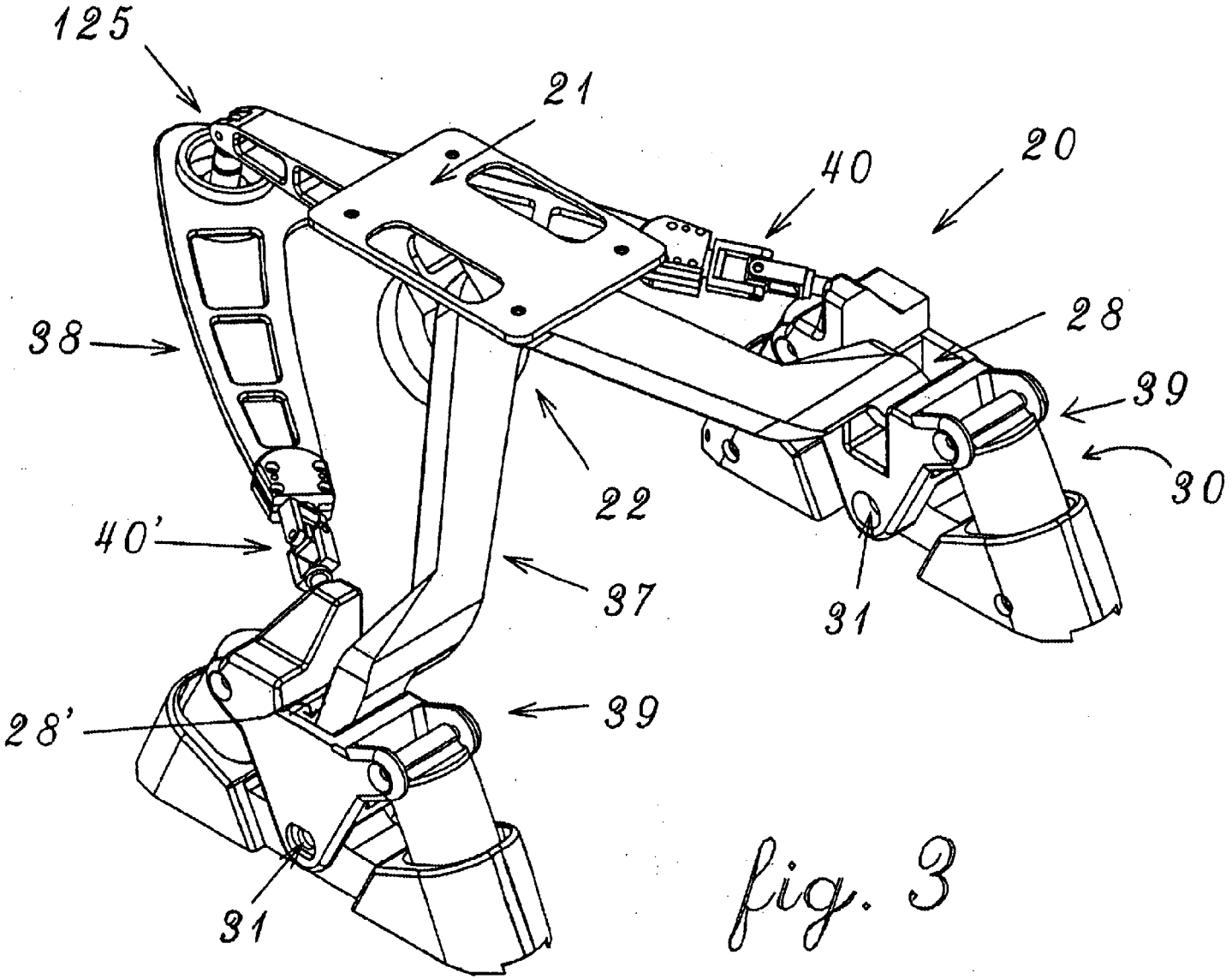
FIG. 3 is a front perspective view of one embodiment of the steering and suspension system of the ski-snowboard of FIGS. 1 and 2.

The cross-arm pivots 28, 28' connect the cross-arm system 37 to the rocker links 29. As illustrated to best advantage in FIGS. 3 and 4, each pivot 28, 28' comprises a bore 128, 128' through each end of the cross-arm, an axle (not shown) that extends through the bore 128, 128' and into holes 228, 228' in the rocker links. Such connection allows the rocker base system 39 and the attached ski 52 to pivot on an axis parallel to the bore 128, 128', which may be called pivoting generally transversely (side-to-side) on an axis parallel to the longitudinal axis of the ski-snowboard, as illustrated by the arrows in FIG. 2.

Figure 7B:
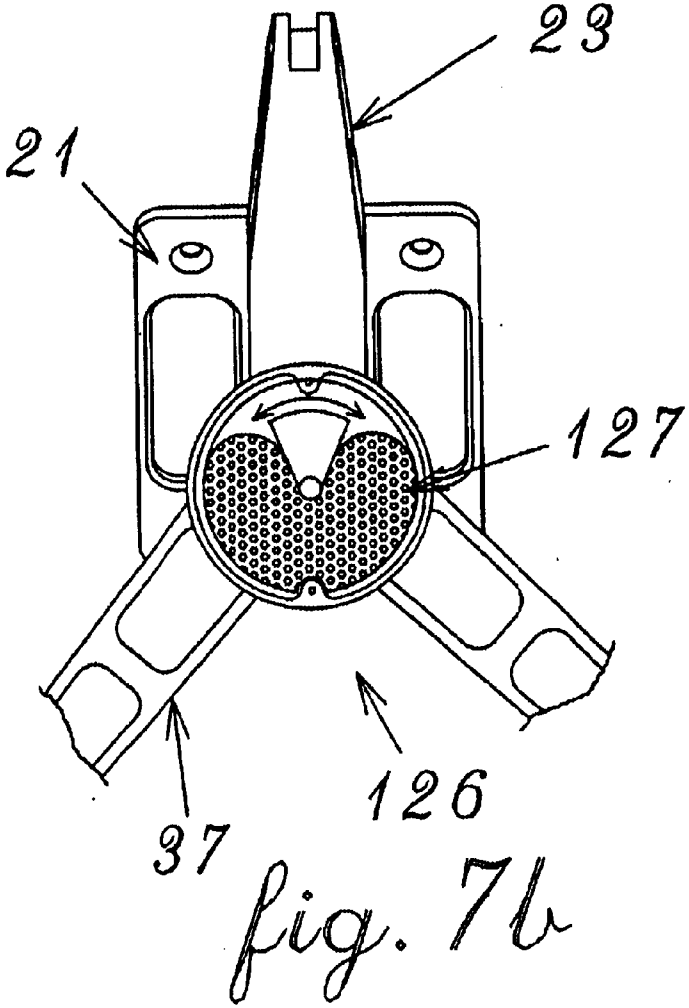
FIG. 7B is a schematic bottom view of the connection between the cross-arm of FIG. 7A and the truck system of FIG. 5.
Figure 7A:
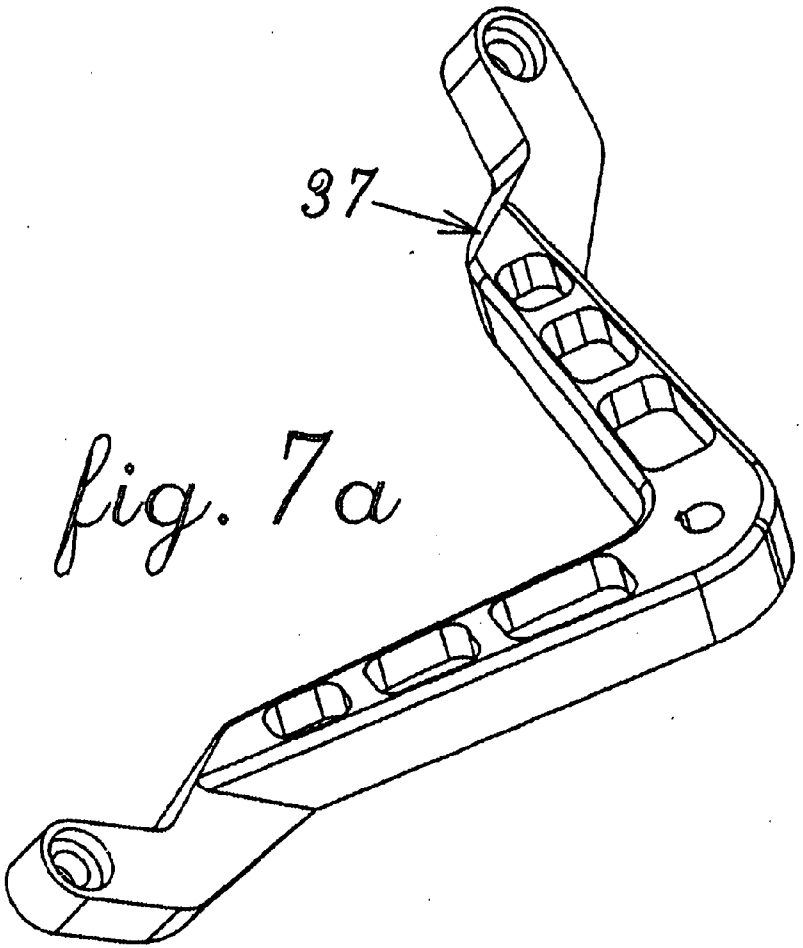
FIG. 7A is a perspective view of one embodiment of a cross-arm of the invention.
Figure 8:
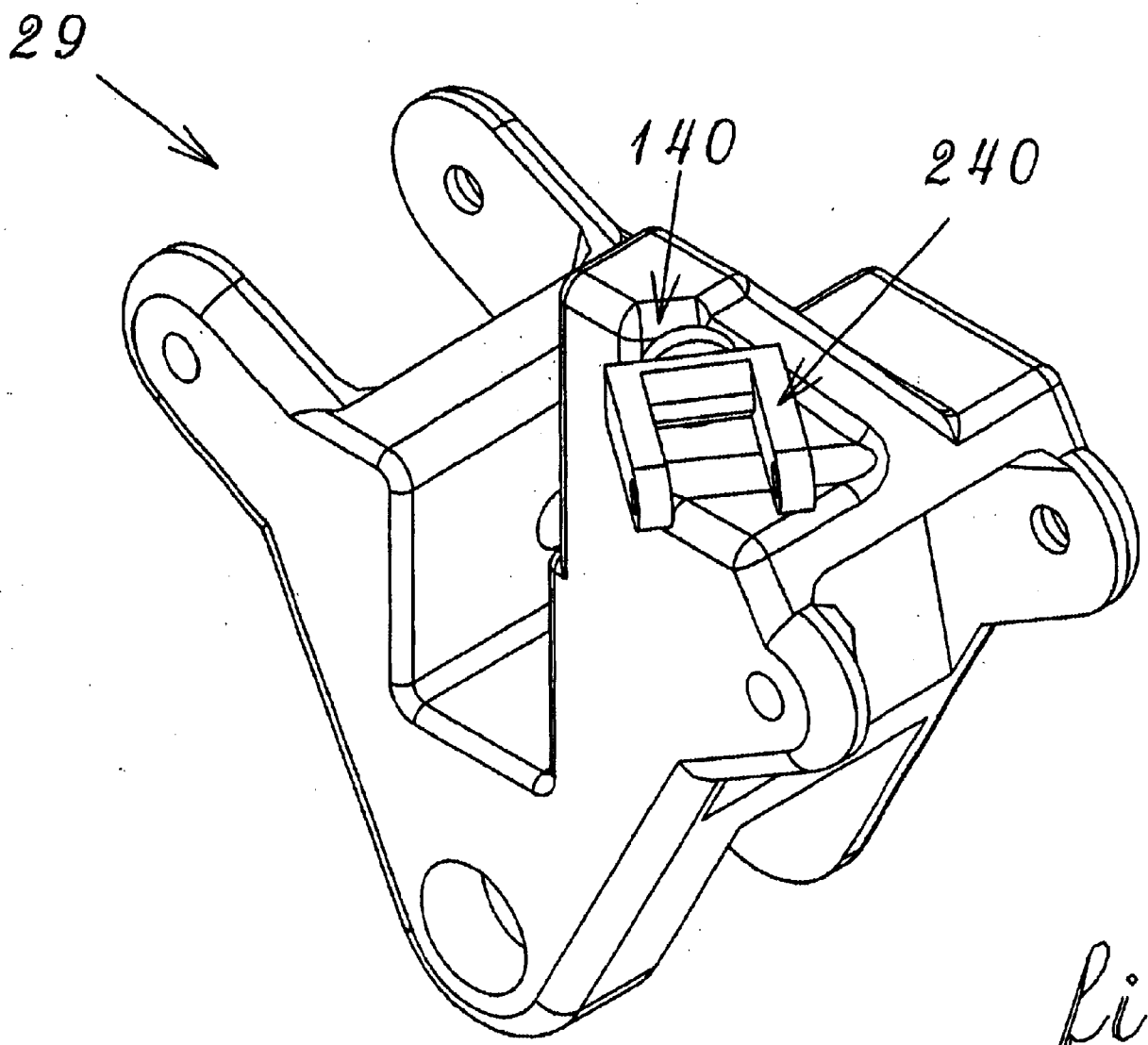
FIG. 8 is a top perspective view of one embodiment of a rocker link of the embodiment of FIGS. 1–4.
Figure 9A:
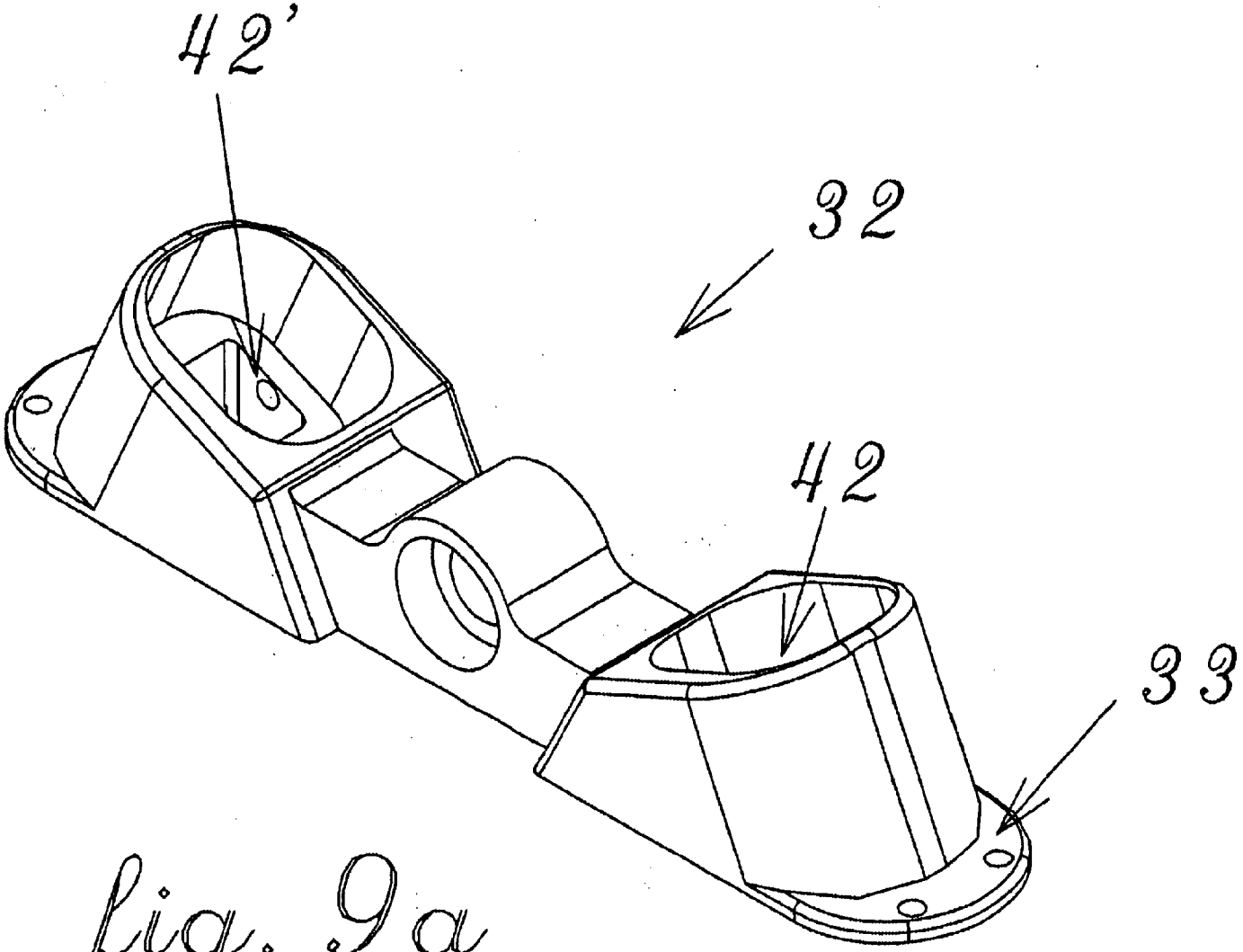
FIG. 9A is a top perspective view of one embodiment of a rocker base of the embodiment of FIGS. 1–4.
Figure 9B:
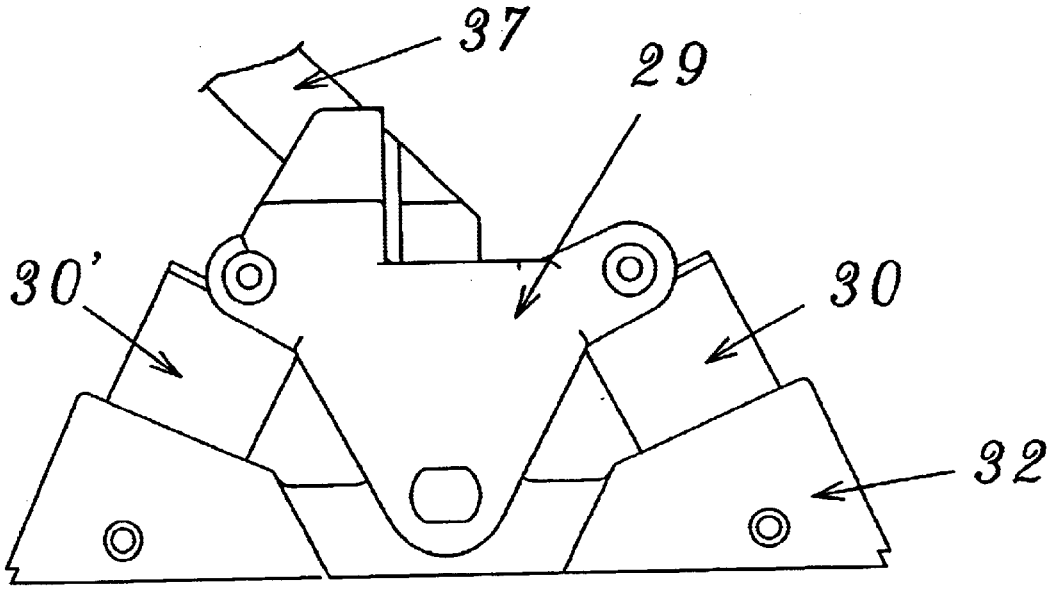
FIGS. 9B, 9C, and 9D are schematic side views of the rocker system of FIGS. 1–4, with the ski pivoting/swinging forward relative to the rocker link in FIG. 9C and rearward relative to the rocker link in FIG. 9D.
Figure 9C:
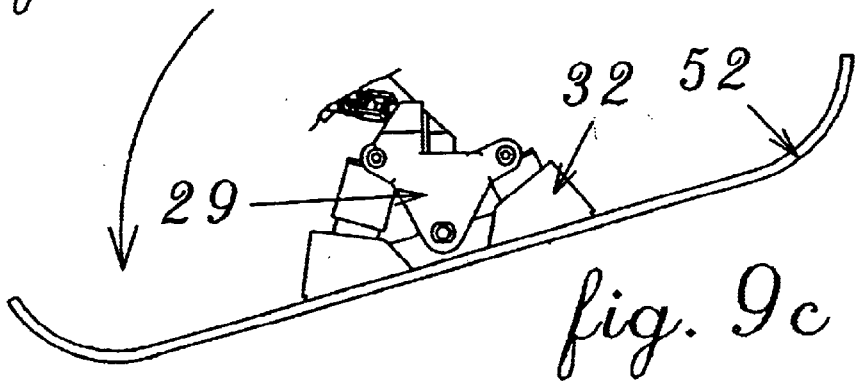
Figure 9D:
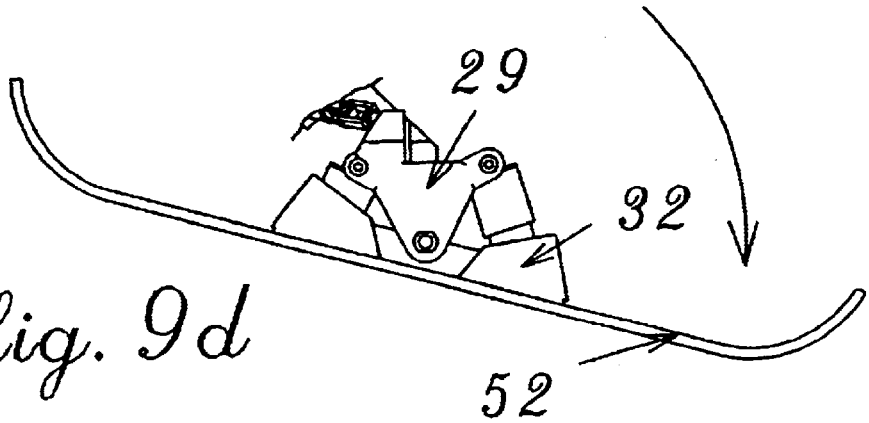
Figure 10A:
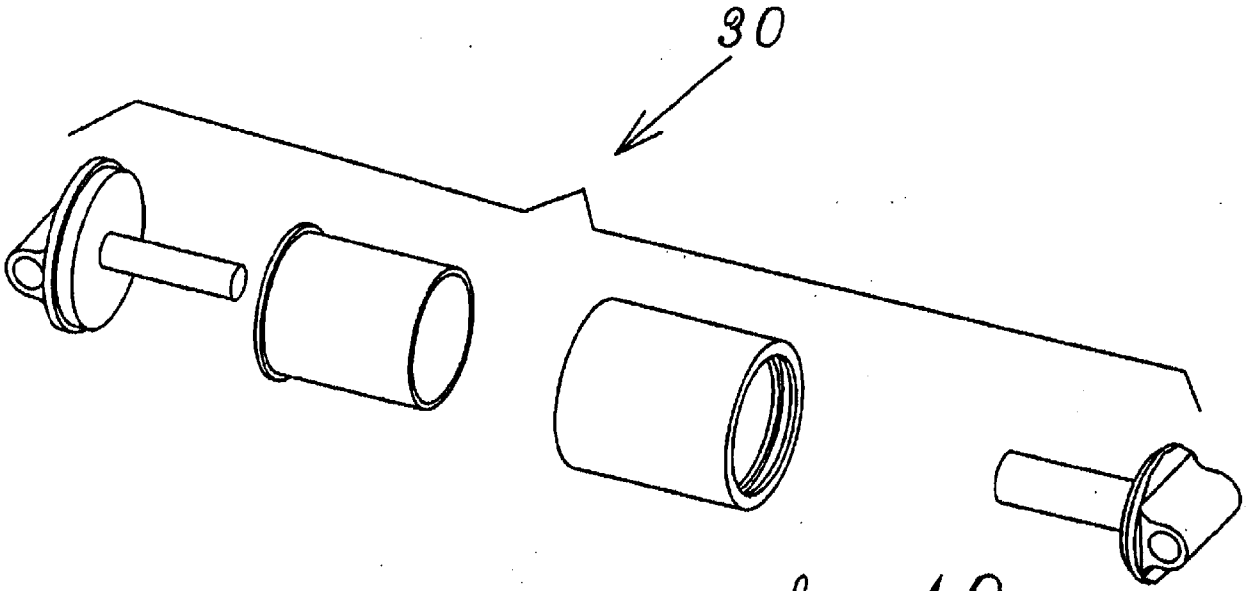
FIGS. 10A and B are perspective views of one embodiment of shock absorber of the embodiment of FIGS. 1–4, exploded and compressed, respectively.
Figure 10B:
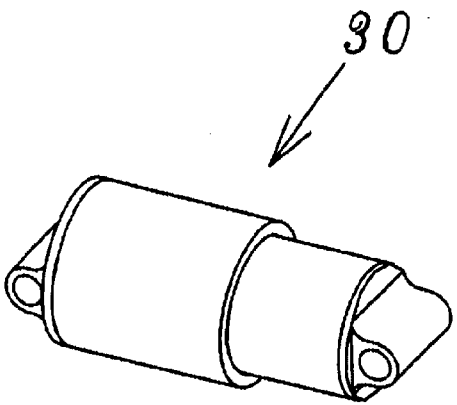

The connection between cross-arm 37 and truck base 23 includes a tensioning system 126, such as an elastomer bushing 127 (such as urethane) or a spring-biased system. As suggested by FIG. 7B, when the cross-arm is turned, for example, during carving left or right, the tensioning means serves to apply tension or resistance so that the ski-snowboard does not flop to one side of the other. This allows a smooth transition and ride. Preferably, the tensioning system 126 is adjustable for adapting the ski-snowboard's response to various conditions and preferred riding style: for example, 4–6 variable settings ranging from hard tensioning for hard pack or ice to softer tensioning for deep powder. This adjustability may be accomplished with replaceable bushings, each bushing having different tension-providing characteristics, for example, or more preferably, an adjustable set of springs that may be tuned to conditions without being removed from the system 126.

Figure 19:
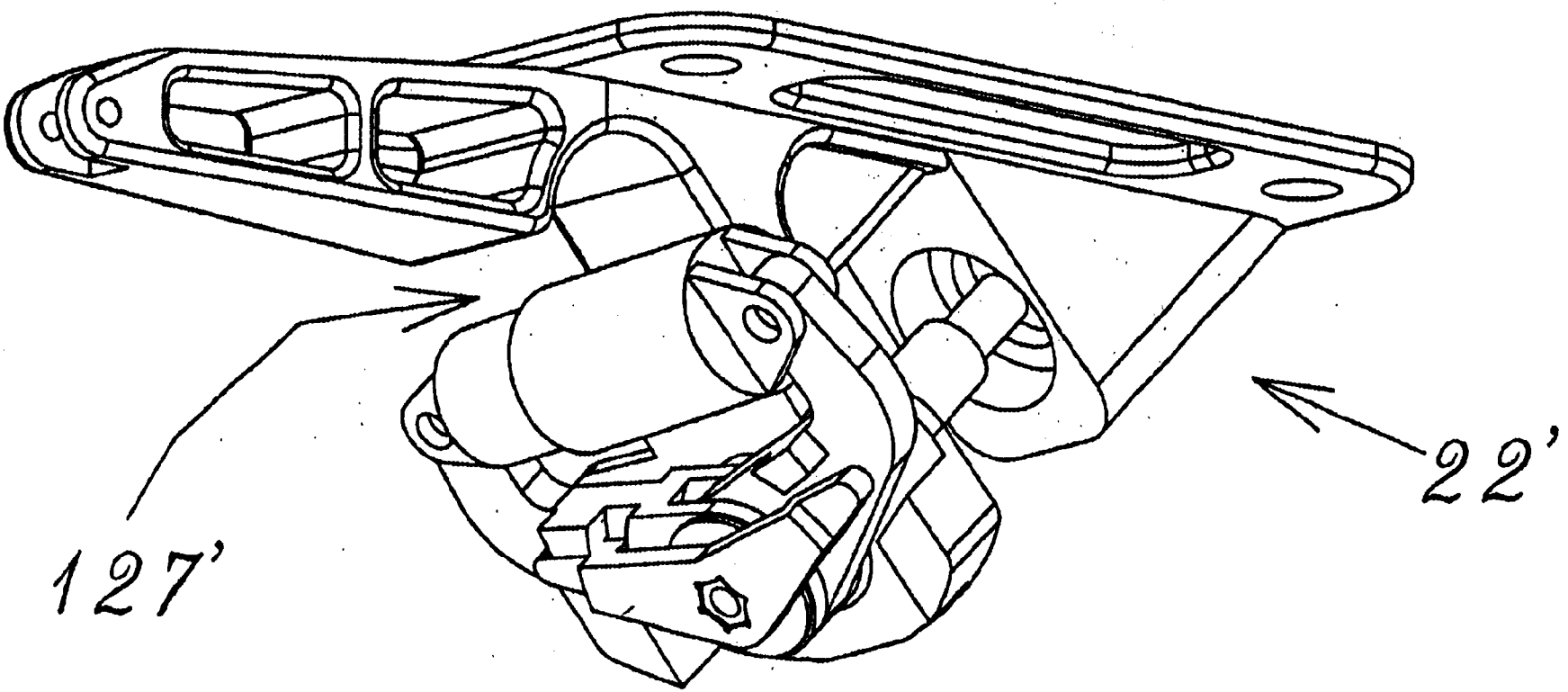
FIG. 19 is a detail bottom perspective view of an embodiment of a truck and spring connection system for connecting a cross-arm to the truck.

An especially-preferred version of the connection between cross-arm and truck base 22', a spring-biased system 127', is shown in FIG. 19.

d. The Rocker Base System

The rocker base system 39 connects the skis 52 to the cross-arm system 37. The rocker base system 39 comprises: a rocker link 29, a pair of shocks 30, 30', a rocker base 32 and a ski attachment 33.

The rocker link 29 connects to the cross-arm 27 at a cross-arm pivot 28. The rocker link 29 further attaches to a front shock 30 and a rear shock 30' mounted within the body of the rocker base 32. These shocks 30, 30' include elastomer bushings that serve to dampen vibrations, and thereby improve handling, as the present invention travels over a snow-covered surface. The shocks 30, 30' also include a spring component that serves to return the skis 52 to their original position, which is typically a "level" position parallel to the plane of the main body of the deck. These shocks 30, 30' are mounted within a pair of shock mounts 42, 42' located in the body of the rocker base 32. Alternatively, a single dual-action or "dual direction" shock absorber may be used instead of two separate shocks 30, 30', to provide dampening and leveling features in both forward and rearward directions for each ski.

Figure 17:
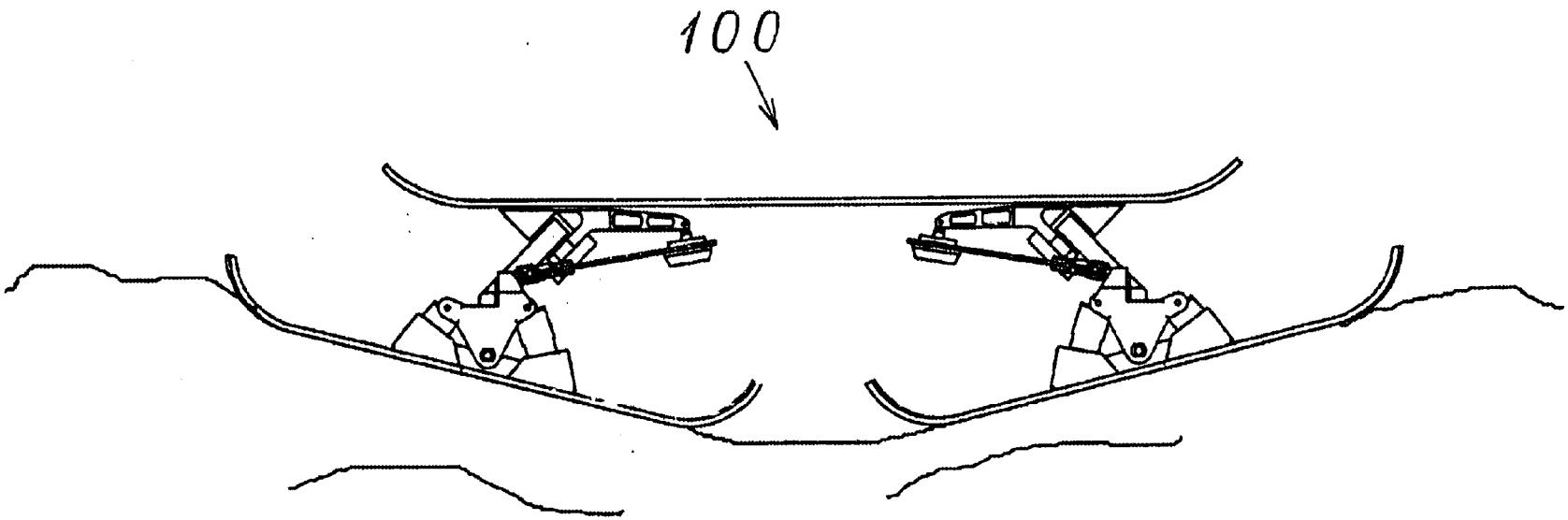
FIG. 17 is a right side view illustrating the front skis of the embodiment of FIGS. 1–4, and 13–17 pivoting forward and the rear skis pivoting rearward to travel across a depression in the snow.

The rocker link 29 allows for pivoting/swinging movement of the ski 52 within a vertical plane parallel to the length of the deck 10, as shown to best advantage in FIG. 17. The rocker link 29 attaches to the rocker base 32 at a rocker base pivot 31, which allows the rocker base 32 to pivot/swing relative to the link 29 and, hence, relative to the deck 10.

As the rocker base 32 pivots forward relative to the link 29, it compresses the front shock 30, dampening vibrations and adding support to the present invention. As the rocker base 32 pivots rearward, away from the front shock 30, the front shock 30 extends into its uncompressed state and the rear shock 30' is compressed.

The rocker base 32 attaches to the top surface of the ski 52 through a ski attachment 33, so that the length of the ski 52 is parallel to the length of the rocker base 32. The ski attachment may comprise the bottom, planar surface of the rocker base 32 being connected to the skis through the use of screws threaded through holes in the rocker base 32 and into the ski 52.

Figure 11B:
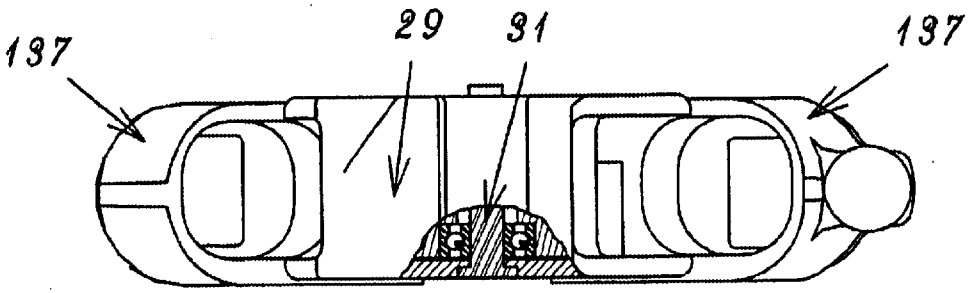
FIG. 11B is a top view of the rocker system of FIG. 11A.
Figure 11A:
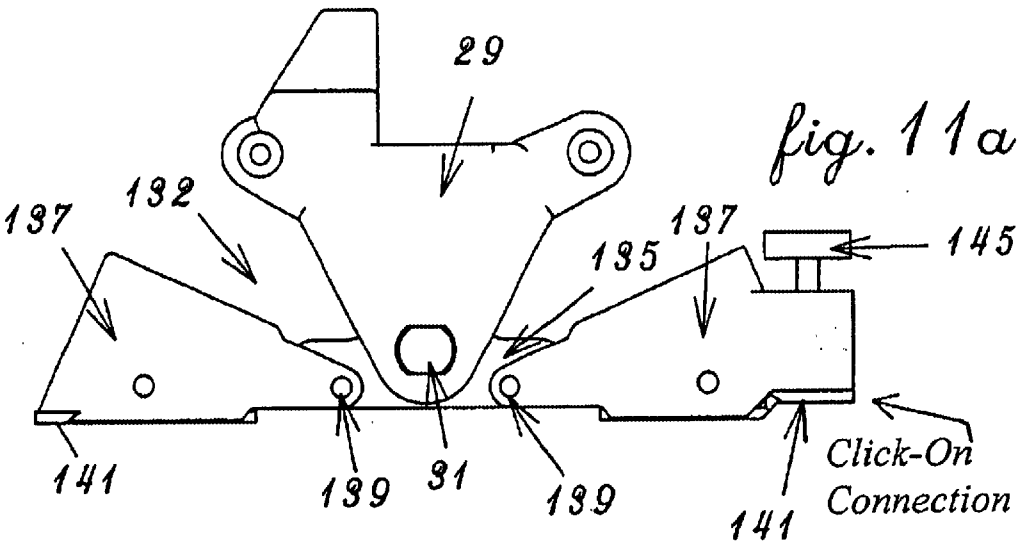
FIG. 11A is a side view of an alternative embodiment of a rocker system.

An alternative, especially-preferred rocker base is an articulated rocker base 132, shown in FIGS. 11A and 11B to best advantage. This rocker base 132 includes a central section 135 that pivotally connects to the link 29, and two end units 137 that attach to the skis and pivot at pivot points 139 relative to the central section 135. A single ski attaches to both the end units 137, with the added benefit that the end units allow the ski to flex somewhat during use.

Figure 11C:
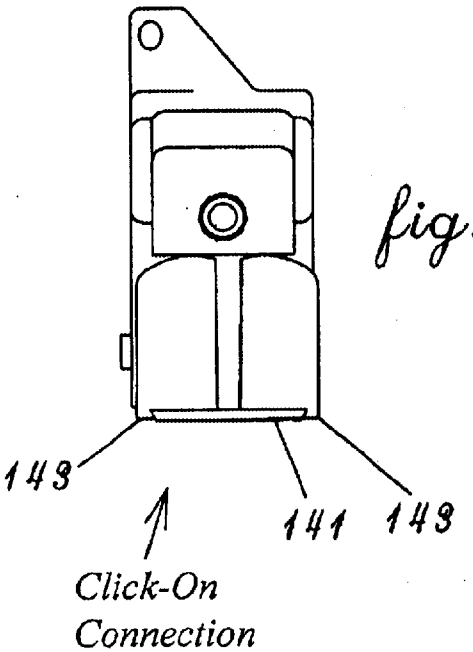
FIG. 11C is an end view of the rocker system of FIGS. 11A and B, illustrating a lock system for locking a ski to the rocker base.

Instead of a screw-on ski attachment to the rocker base, other ski attachments may be used, for example, a snap-on "click" connection or another quick-release connection may be used. Such a connection may make the skis quickly interchangable with other skis to accommodate different riding styles. For example, FIGS. 11A and 11C illustrate a click-on connection 140, in which a dove-tail plate system is used. Two longitudinally spaced plates 141 are installed with screws or other means on a ski at the positions corresponding to the end units 137. The side edges of the plates 141 are dove-tailed or otherwise shaped for being slidably received in and retained in the groove in the bottom surface of end units 137. Thus, the ski may be slid longitudinally onto the end units 137 and is thereby held by edges 143 from falling vertically off of the rocker base. In addition, a locking mechanism is engaged to prevent any longitudinal movement of the ski relative to the rocker base until desired for removal of the ski. For example, a push-button or "plunger"-style lock 145 is shown in FIG. 11A, which features a post perpendicular to the plate 141 that may be pushed down into an aperture in plate 141 to lock the ski onto the rocker base 132.

Figure 12:
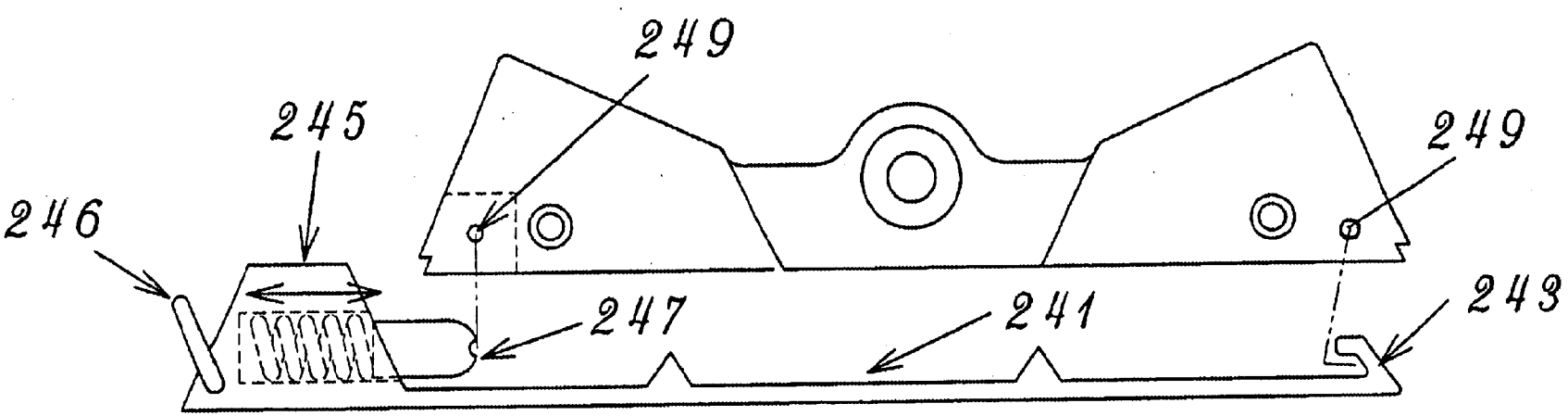
FIG. 12 is a schematic side view of an alternative embodiment of a ski attachment system.
Figure 13:
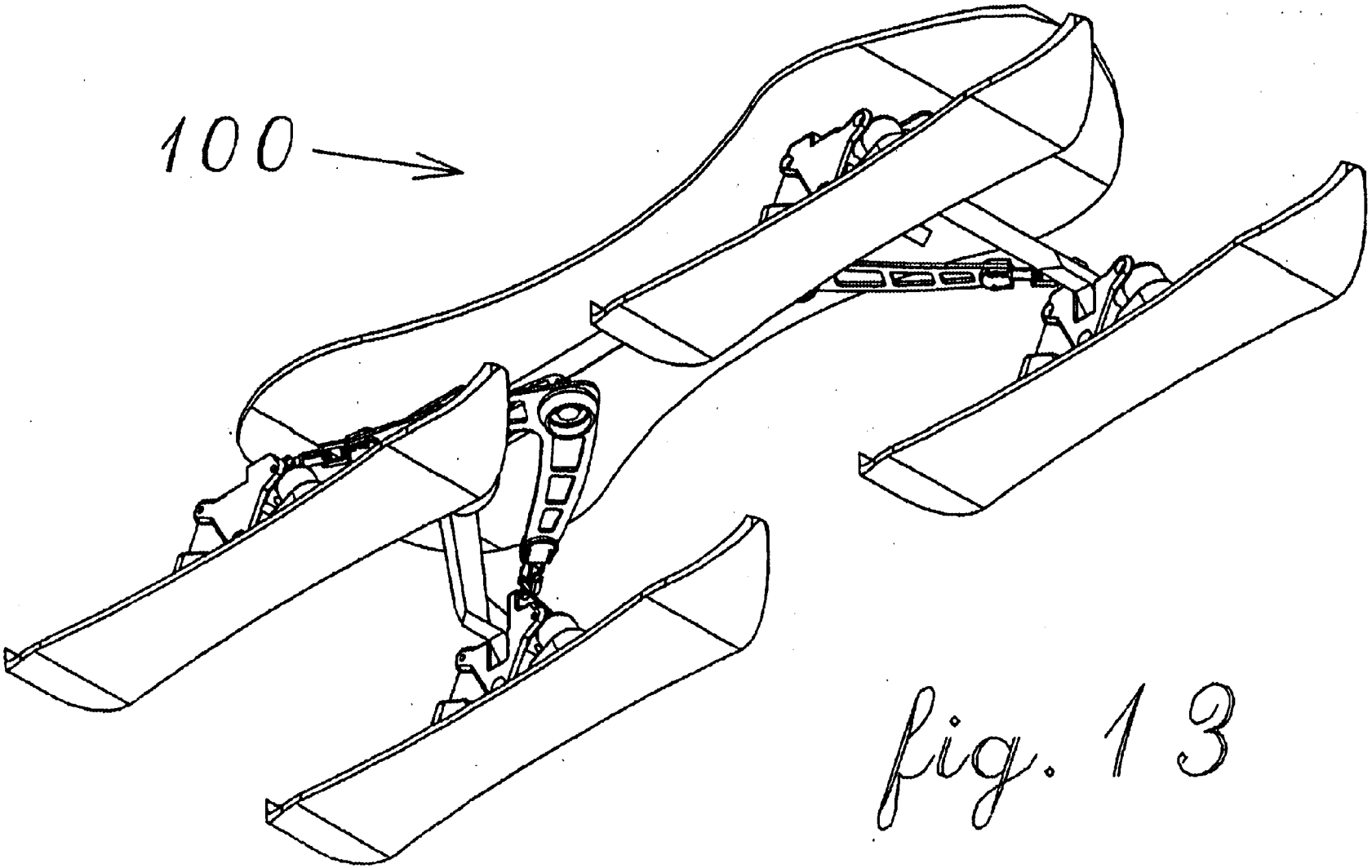
FIG. 13 is a bottom perspective view of the embodiment of FIGS. 1–4 with skis generally in the straight "neutral" position.

An alternative click-in ski connection is shown in FIG. 12, wherein a plate 241 is again screwed to the ski, wherein the plate 241 comprises a hooked end 243 and a spring-loaded lock 245 with a plate release handle 246 on the other end. The rocker base is slid at one end under the hook 243 of the plate and then the other end of the rocker base is snapped down to engage the latch piece 247 of the lock 245. The portions of the rocker base that latch under the latch piece 247 and the hook 243 may be internal pins 249 mounted horizontally in the rocker base near the rear end and front end, for example. The lock 245 may be designed to be released in various conventional ways.

3. The Ski System

Each of the laterally-spaced skis 52 comprises an elongated, preferably continuous, single piece having a smooth flat bottom surface for contact with a snow-covered surface. The width is narrow compared to the length of the ski, the width preferably being in the range of less than ¼ of the length of the ski. Individual ski length is preferably 18–24 inches, and individual ski width is preferably 2–4 inches. Additionally, the narrow ends 51 of the skis 52 may be tapered and/or upwardly-curved. The skis 52, 52' of each pair of skis are positioned generally equidistantly apart. Preferably the two skis on each side of the deck are several inches apart at their inner tips, and the outer tips extend beyond the front and rear end of the deck. Conventional ski technology may be used to produce the skis of this invention.

Preferably, four skis 52, 52' are used, but differing numbers are possible. For example, the inventor envisions embodiments with a total of two skis per ski-snowboard, that is, long skis which extend substantially along the length of the deck. Each of the long skis would preferably have a steering-suspension system 20 or one similar thereto.

Different ski models that may be installed on the invented ski-snowboard are, for example, free style and all mountain/directional (slalom) with various dimensions. For example, freestyle/pipe skis will be about 21–23 inches in length with a narrow waist, while all mountain/directional skis will be 23–25 inches in length with a wider waist. Other sizes and shapes of skis may also prove beneficial or interesting for a desired effect.

4. Use of the Present Invention

The present invention is preferably used by the user standing upon the upper surface of the deck 10. However, an embodiment of the present invention could also be created where the user kneels or sits on the deck 10 of the invention.

Preferably, the ski-snowboard is used by placing the board at the top of a snow-covered hill. The user then stands on the deck 10 of the board, placing both feet upon the upper surface of the deck 10, preferably one or more feet in bindings (not shown) that are attached to the upper deck surface, allowing the user's feet to be similarly positioned as they would on a skateboard. The user then pushes off, thereby propelling the user and ski-snowboard downhill. As the board slides over the snow, the user may shift his or her weight to either the left side of the board or the right side of the board in order to manipulate the board in a preferred direction.

As the user shifts his or her weight to the left side of the board, the left side of the deck 10 tilts downwards causing the front skis 52 to slightly rotate counterclockwise within a horizontal plane and causing the rear skis 52' to slightly rotate clockwise within a horizontal plane. Thus, the skis rotate/turn into a curved line or "arc" as illustrated to best advantage in FIGS. 14–16, for smooth turning. Thus, as the user leans to the left, the front skis 52 and rear skis 52' turn opposite of one another, thereby allowing the ski-snowboard 100 to sharply turn the direction the user has leaned. As the user ceases to lean to one side of the board, the skis would return to their default position parallel to the length of the deck 10.

Figure 14:
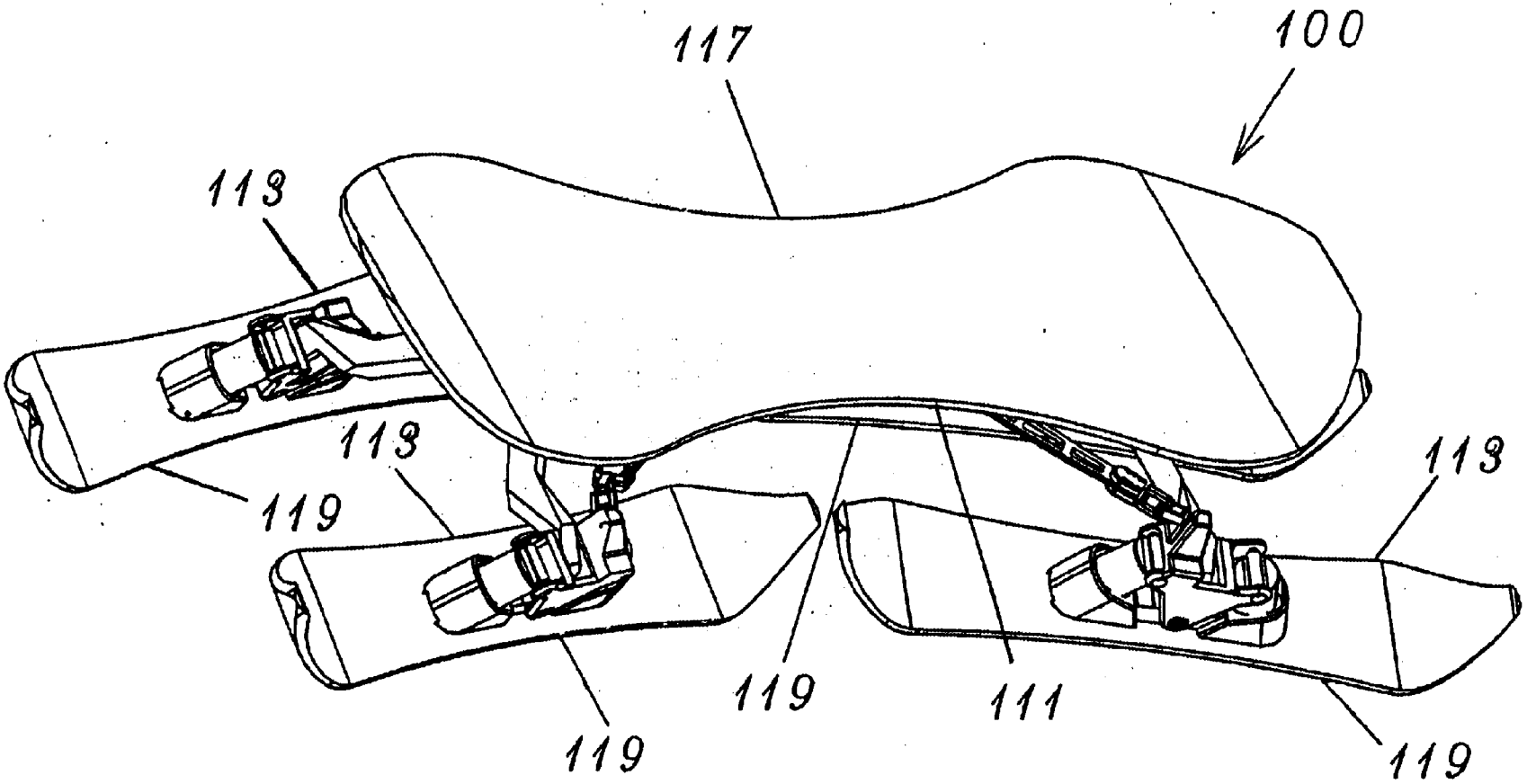
FIG. 14 is a top perspective view of the embodiment of FIGS. 1–4, and 13, with skis turned to move the ski-snowboard slightly to the right.
Figure 15:
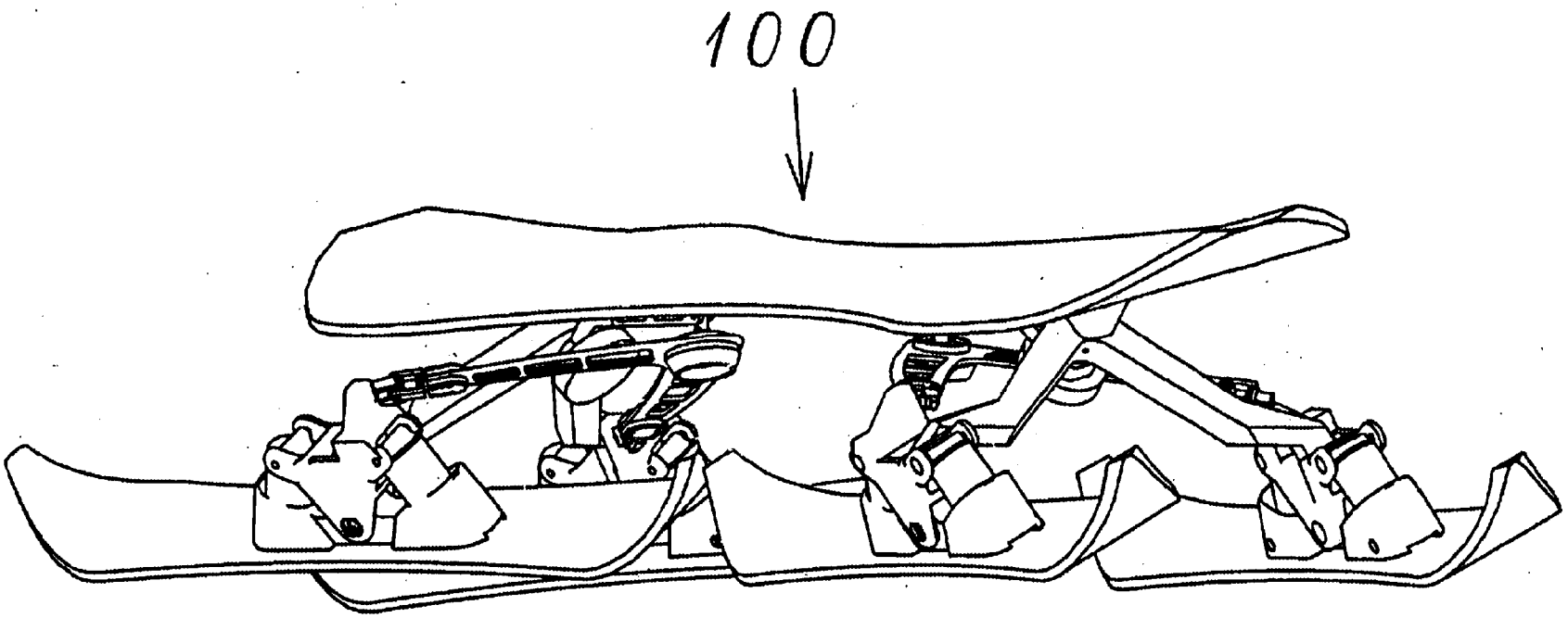
FIG. 15 is a right side perspective view of the embodiment of FIGS. 1–4, 13, and 14, with skis turned to move the ski-snowboard to the right.
Figure 16:
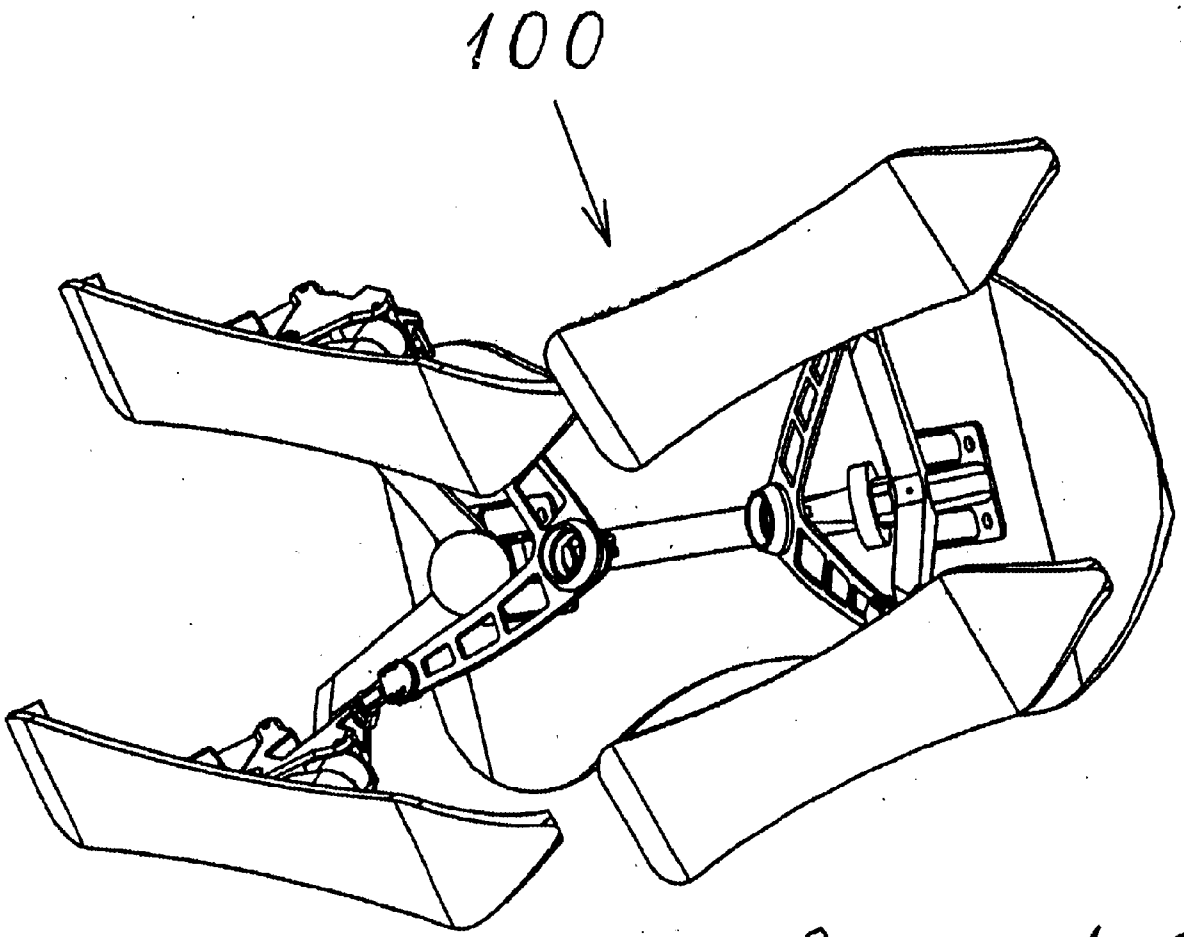
FIG. 16 is a bottom perspective view of the embodiment of FIG. 15, showing the skis turned in opposite directions to allow the ski-snowboard to turn to the right.

The operation of the steering mechanism is simple and smooth, as suggested in the various views of FIGS. 13–17. As the user leans to the right, the right side-edge 111 of the deck 10 tilts downwards to the right, causing the front skis to rotate clockwise and the rear skis to rotate counter clockwise, the pivot rod pulls (lifts) the outside edge (which in FIG. 14 is the left side-edge 113) of each ski allowing the rider to turn (carve) on the proper edge (the inside edge), as you would on typical skis. For instance, the user leans to the left, the left side-edge 117 of the deck 10 tilts downwards to the left, causing the front skis to rotate counter clockwise and the rear skis to rotate clockwise, the pivot rod pulls (lifts) the outside edge (that is, the outside edge relative to the direction of turning) of each ski allowing the rider to turn (carve) on the proper edge (the inside edge relative to the direction of turning), as you would on typical skis. For example, if the ski-snowboard in FIG. 14 changed position to turn left, the right side-edges 119 of the skis would move upward and the left side-edges would move down. Having the skis tilt/tip on the proper riding edge is a major role in the performance of the board and is the main function of the pivot rod.

As the rider ceases leaning and returns to the neutral position, he is also aided by the elastomer bushing or torsion spring of tension system 126, helping the rider return to the neutral position from either a left turn or right turn.

The benefit of the front and rear ski pairs pivoting forward and rearward independently is that the invented ski-snowboard 100 is able to more smoothly transverse uneven surfaces, such as moguls. For instance, as the user travels across a small mogul, the front skis may be pointed down the back side of the mogul, while the rear skis are pointed up the front side of the mogul. Or, as shown in FIG. 17, when the board is in the depression between two moguls, the front skis point up and the rear skis point down. This feature allows the board to remain generally level as small hills and moguls are crossed.

Figure 18A:
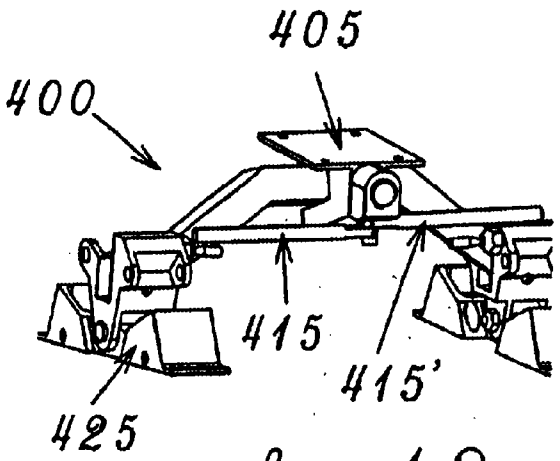
FIG. 18A is a perspective view of an alternative embodiment of the invented steering and suspension system.
Figure 18B:
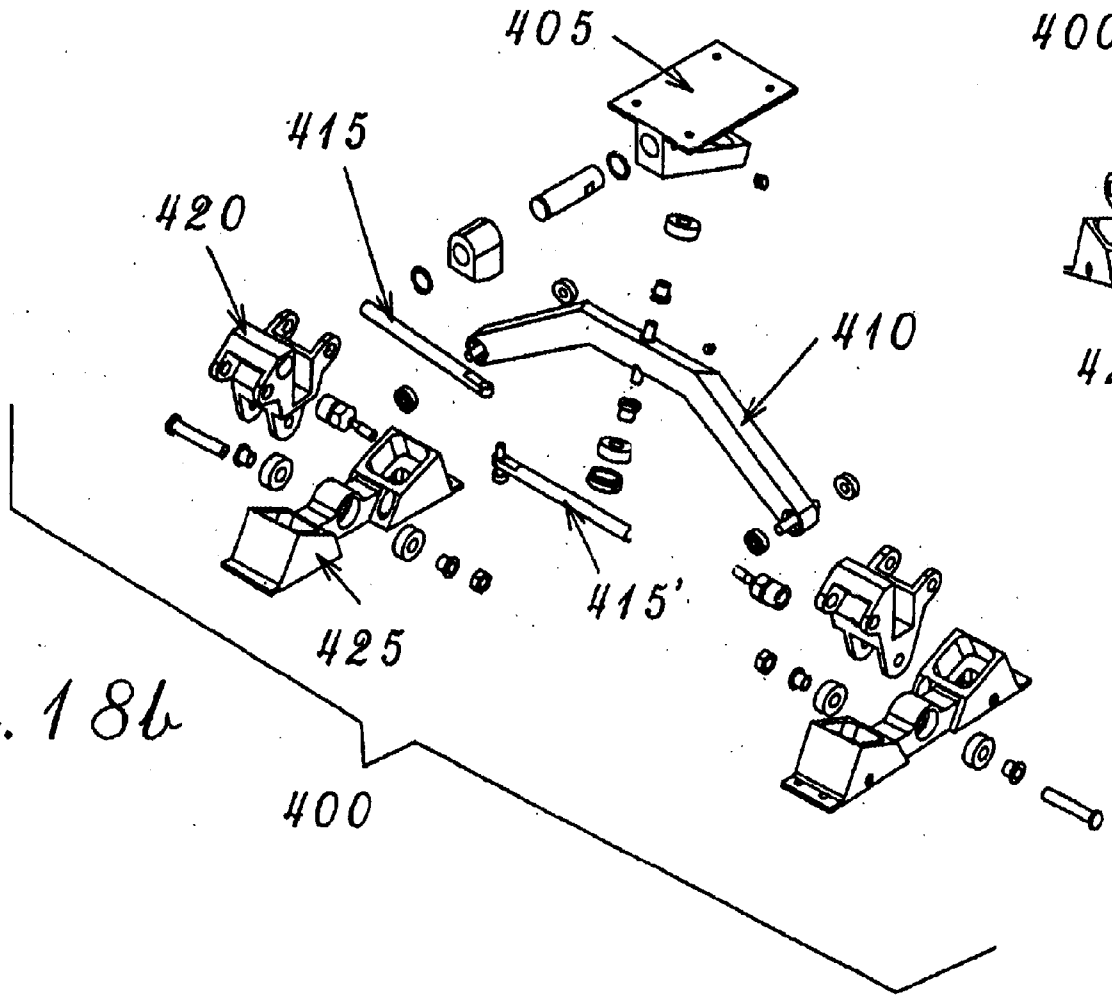
FIG. 18B is an exploded view of the embodiment of FIG. 18A.

An alternative design is shown in FIGS. 18A and 18B, wherein pieces-parts similar to the preferred embodiment are shown both exploded and connected. This ski-snowboard steering and suspension system 400 comprises truck 405, cross-arm 410, two pivot arms 415, 415', rocker link 420, and rocker base 425, with associated pins, bearings, bushings, and fasteners. A main difference between this system 400 and the preferred embodiment is that there are right and left pivot arms rather than a single, boomarang-style pivot arm.

Although this invention has been described above with reference to particular means, materials and embodiments, it is to be understood that the invention is not limited to these disclosed particulars, but extends instead to all equivalents within the broad scope of the following claims.

I claim:

1. A ski-snowboard comprising:

a deck having a bottom surface, a top surface for supporting a user, a front end, a rear end, a first side-edge and a second side-edge;

a pair of skis for contacting a snow or ice-covered surface, each ski having a first ski side-edge parallel to the deck first side-edge and a second ski side-edge parallel to the deck second side-edge: and a steering and suspension system connecting said pair of skis to the deck bottom surface, wherein the steering and suspension system comprises a pivot arm unit pivotally connected to the deck and extending to connect to each of said skis, so that when the deck is tipped to the first side, the pivot arm pulls the skis to tip to their first ski side-edges;

wherein the steering and suspension system further comprises a cross-arm pivotally connected to the deck so that the cross-arm pivots in a plane that is between 22 and 60 degrees down from the deck bottom surface, the cross-arm having two arms and each of said arms extending to and pivotally connecting to one ski of said pair of skis, so that each ski pivots to near the deck first side-edge and to near the deck second side-edge and so that each ski pivots vertically forward toward the deck front end and rearward toward the deck rear end; and wherein the cross-arm pivotally connects to said pair of skis by means of a rocker base attached to each ski, the rocker base having an upper portion pivotally connected to the cross-arm and having a lower portion pivotally connected to the ski, and wherein the rocker base comprises a shock absorber providing resistance to said vertical pivoting toward the deck front end and rearward toward the deck rear end.

2. A ski-snowboard comprising:

a deck having a bottom surface, a top surface for supporting a user, a front end, a rear end, a first side-edge and a second side-edge;

a front pair of skis and a rear pair of skis for contacting a snow or ice-covered surface, each ski having a first ski side-edge parallel to the deck first side-edge and a second ski side-edge parallel to the deck second side-edge;

a front steering and suspension system connecting said front pair of skis to the deck bottom surface, and a rear steering and suspension system connecting said rear pair of skis to the deck bottom surface;

wherein said front steering and suspension system comprises a pivot arm unit pivotally connected to the deck and having two pivot arms extending down and forward to connect to said front pair of skis, so that when the deck is tipped to the first side-edge, the pivot arm unit pulls the two skis of said front pair of skis to tip to their first ski side-edges; and wherein said rear steering and suspension system comprises a pivot arm unit pivotally connected to the deck and having two pivot arms extending down and rearward to connect to said rear pair of skis, so that when the deck is tipped to the first side-edge, the pivot arm unit pulls the two skis of said rear pair of skis to tip to their first ski side-edges;

wherein the front steering and suspension system comprises a front cross-arm pivotally connected to the deck so that the cross-arm pivots in a plane that is between 22 and 60 degrees down from the deck bottom surface, wherein the front cross-arm has two arms, each of said arms extending down and forward, and pivotally connecting, to one ski of said front pair of said skis.

3. The ski-snowboard as in claim 2, wherein the front cross-arm pivotally connects to said front pair of skis by means of two rocker bases, one of said two rocker bases attached to each ski, each rocker base having an upper portion pivotally connected to the respective cross-arm and having a lower portion pivotally connected to the respective ski.

4. The ski-snowboard as in claim 3, wherein each rocker base comprises a shock absorber providing resistance to said pivoting toward the deck front end and rearward toward the deck rear end.

5. The ski-snowboard as in claim 2, wherein deck has a length between the deck front end and the deck rear end, and the front pair of skis and the rear pair of skis are parallel to the deck length.

6. The ski-snowboard as in claim 5, wherein the skis of the front pair of skis have front tips extending forward beyond the front end of the deck, and therein the skis of the rear pair of skis have rear tips extending rearward beyond the rear end of the deck.

7. A ski-snowboard comprising:

a deck having a bottom surface, a top surface for supporting a user, a front end, a rear end, a first side-edge and a second side-edge;

a front pair of skis and a rear pair of skis for contacting a snow or ice-covered surface, each ski having a first ski side-edge parallel to the deck first side-edge and a second ski side-edge parallel to the deck second side-edge;

a front steering and suspension system connecting said front pair of skis to the deck bottom surface, and a rear steering and suspension system connecting said rear pair of skis to the deck bottom surface;

wherein said front steering and suspension system comprises a pivot arm unit pivotally connected to the deck and having two pivot arms extending down and forward to connect to said front pair of skis, so that when the deck is tipped to the first side-edge, the pivot arm unit pulls the two skis of said front pair of skis to tip to their first ski side-edges; and wherein said rear steering and suspension system comprises a pivot arm unit pivotally connected to the deck and having two pivot arms extending down and rearward to connect to said rear pair of skis, so that when the deck is tipped to the first side-edge, the pivot arm unit pulls the two skis of said rear pair of skis to tip to their first ski side-edges;

wherein the rear steering and suspension system comprises a rear cross-arm pivotally connected to the deck so that the cross-arm pivots in a plane that is between 22 and 60 degrees down from the deck bottom surface, wherein the rear cross-arm has two arms, each of said arms extending down and rearward, and pivotally connecting, to one ski of said rear pair of said skis.

8. The ski-snowboard as in claim 7, wherein the rear cross-arm pivotally connects to said rear pair of skis by means of two rocker bases, one of said two rocker bases attached to each ski of the rear pair of skis, each rocker base having an upper portion pivotally connected to the respective cross-arm and having a lower portion pivotally connected to the respective ski.

9. The ski-snowboard as in claim 8, wherein each rocker base comprises a shock absorber providing resistance to said pivoting toward the deck front end and rearward toward the deck rear end.

10. The ski-snowboard as in claim 7, wherein deck has a length between the deck front end and the deck rear end, and the front pair of skis and the rear pair of skis are parallel to the deck length.

11. The ski-snowboard as in claim 10, wherein the skis of the front pair of skis have front tips extending forward beyond the front end of the deck, and therein the skis of the rear pair of skis have rear tips extending rearward beyond the rear end of the deck.

* * * * *